US005453753A

United States Patent [19]

Cosenza et al.

[11] Patent Number: 5,453,753

[45] Date of Patent: Sep. 26, 1995

[54] MECHANICALLY STEERABLE MODULAR PLANAR PATCH ARRAY ANTENNA

[75] Inventors: John M. Cosenza, St. James; Samuel Goldfarb, Roslyn; Shaun G. Moore, Shirley, all of N.Y.

[73] Assignee: Dorne & Margolin, Inc., Bohemia, N.Y.

[21] Appl. No.: 117,624

[22] Filed: Sep. 8, 1993

[51] Int. Cl.[6] ..... H01Q 3/08

[52] U.S. Cl. ..... 343/765; 343/766; 343/882

[58] Field of Search ..... 343/765, 766, 343/763, 882, 709; 333/256, 257

[56] References Cited

U.S. PATENT DOCUMENTS

| | | | |
|---|---|---|---|
| 2,960,693 | 11/1960 | Fry | 343/765 |
| 3,283,327 | 11/1966 | Stuckey, Jr. et al. . | |
| 3,673,606 | 6/1972 | Maune . | |
| 3,737,906 | 6/1973 | Maynard . | |
| 3,953,857 | 4/1976 | Jenks . | |
| 3,987,451 | 10/1976 | Peterson . | |
| 4,281,328 | 7/1981 | Shores | 343/763 X |
| 4,626,864 | 12/1986 | Micklethwaite | 343/882 X |
| 4,628,323 | 12/1986 | Crean | 343/765 |
| 4,739,337 | 4/1988 | Anderson | 343/882 |
| 4,779,097 | 10/1988 | Morchin . | |
| 4,920,350 | 4/1990 | McGuire et al. | 343/766 X |
| 4,922,259 | 5/1990 | Hall et al. . | |
| 5,025,262 | 6/1991 | Abdelrazik et al. . | |
| 5,153,485 | 11/1992 | Yamada et al. | 343/766 X |
| 5,160,936 | 11/1992 | Braun et al. . | |
| 5,227,806 | 7/1993 | Eguchi | 343/765 |
| 5,245,351 | 9/1993 | Chou | 343/765 X |
| 5,281,975 | 1/1994 | Hugo | 343/766 |

*Primary Examiner*—Donald Hajec
*Assistant Examiner*—Tho G. Phan
*Attorney, Agent, or Firm*—Sughrue, Mion, Zinn, Macpeak & Seas

[57] ABSTRACT

A planar patch array antenna for satellite communications. The antenna includes a planar patch array and a dual axis positioner for rotating the array about azimuth and elevation axes. The dual axis positioner is unique in that it consists of a plurality of individual modules which can be easily assembled and disassembled. The positioner consists of the following modules: a fixed pedestal, an azimuth drive module, an azimuth rotary module, an RF/slip ring module, an elevation drive module, an antenna support and an electronic module. According to the invention, the pedestal remains fixed and the azimuth drive module is received in a recess defined by the pedestal. The azimuth rotary module is rotatably supported on the pedestal and is driven by the azimuth drive module so that it rotates about the vertical or azimuth axis. The elevation drive module is fixed to the rotary drive module and rotatably supports the antenna support module. The elevation drive module includes a drive mechanism for causing the antenna support module and, attendantly, the antenna array secured thereto, to rotate about the elevation axis. Finally, the RF/slip ring module is provided within the elevation drive module for supplying RF power to the antenna array and for supplying DC power to the elevation drive module.

15 Claims, 7 Drawing Sheets

MECHANICALLY STEERABLE MODULAR PLANAR PATCH ARRAY ANTENNA

BACKGROUND OF THE INVENTION

The present invention relates to a mechanically steerable modular planar patch array antenna operable at the Inmarsat frequencies for mechanically tracking communication satellites. The antenna consists of a plurality of modules facilitating easy maintenance and repair thereof.

Conventionally, antennas are steered either electronically or mechanically. However, electronically steered antennas suffer from deficiencies in regard to the ability to track communication satellites over a broad hemispherical range. In particular, electronically steerable antennas suffer loss of communication due to gaps, holes or related RF field of view problems due to electronic scanning losses. On the other hand, use of mechanically steered antennas has been limited to use in radar systems such as that which is disclosed in U.S. Pat. No. 5,153,485. Accordingly, in the communication satellite field there is a significant deficiency in regard to the ability to effectively track communication satellites over the entire upper hemisphere.

Another deficiency associated with present radar design concerns the maintainability of the antenna, and particularly mechanically steered antennas. Mechanically steered antennas require a positioner for mechanically rotating the antenna array and for supplying the necessary electrical signal thereto. For example, conventionally positioners include azimuth and elevation drive trains including azimuth and elevation drive motors for rotating the antenna array, a rotary joint for supplying the electrical signals to the array and the elevation drive motor and the like. From the viewpoint of maintainability, it is important that the different elements of the positioner be capable of being replaced quickly and easily to minimize the down-time of the antenna. However, in conventional mechanically steerable antennas used for radar systems the positioner is built as a single unit. Therefore, when one of the components of the unit such as the azimuth drive motor is defective, an excessive amount of time is required to replace the components.

Based on the foregoing, there is a demand for mechanically steerable antennas in the area of communication systems to improve the range at which satellite signals can be received. Additionally, there is a demand for an improved positioner design which comprises various individual modules to enable replacement of specific malfunctioning modules without having to remove or replace other functioning modules.

SUMMARY OF THE INVENTION

Accordingly, it is one object of the present invention to provide a planar patch array antenna which is mechanically steerable for satellite communications in the 1530–1660.5 MHz frequency range and which is capable of full upper hemisphere R.F. performance.

It is another object of this invention to provide a mechanically steerable antenna with minimal installation requirements and life cycle cost.

To achieve these and other objects, the present invention is directed to an antenna which includes a planar patch array and a dual axis positioner for rotating the array about azimuth and elevation axes. The dual axis positioner is unique in that it consists of a plurality of modules which can (a) be manufactured and quality inspected individually, and (b) be easily assembled and disassembled. The positioner consists of the following modules: a fixed pedestal, an azimuth drive module, an azimuth rotary module, an RF/slip ring module, an elevation drive module, an antenna support and an electronic module. According to the invention, the pedestal remains fixed and the azimuth drive module is contained in a recess defined by the pedestal. The azimuth rotary module is rotatably supported on the pedestal and is driven by the azimuth drive module so that it rotates about the vertical or azimuth axis. The elevation drive module is fixed to the rotary drive module and rotatably supports the antenna support module. The elevation drive module includes a drive mechanism for causing the antenna support module and, attendantly, the antenna array secured thereto, to rotate about the elevation axis. Finally, the RF/slip ring module is provided within the elevation drive module for supplying RF power to the antenna array and for supplying DC power to the elevation drive module.

The RF/slip ring modules include an RF joint including a housing fixed to the pedestal, a fixed input terminal fixed to the housing and a rotatable output terminal rotatable with respect to the housing. A support arm is connected at one end thereof to a sleeve of the elevation drive module and at the opposite end thereof to the output terminal such that rotation of the sleeve causes the output terminal to rotate. In addition to the RF joint, the RF/slip ring module also includes a slip ring for supplying current to the elevation drive module. The slip ring includes a tubular member having a plurality of conductive tracks circumscribed therearound to which input wires are respectively connected and a brush block including a plurality of brushes extending therefrom and respectively contacting the tracks. The brush block has a plurality of wires electrically connected to respective ones of the brushes. The tubular member is secured to the pedestal with the RF joint disposed within the opening defined by the tubular member, and the brush block is secured to the drive sleeve. Thus, a single module is provided which accommodates both the RF joint and the slip ring so that the antenna can continuously rotate about the azimuth axis while supplying the necessary RF power to the antenna array and the necessary AC/DC power and drive command signals to elevation drive module.

BRIEF DESCRIPTION OF THE DRAWINGS

The invention will be described below with reference to the accompanying drawings, in which.

DETAILED DESCRIPTION OF THE PREFERRED EMBODIMENT

Figure 1:
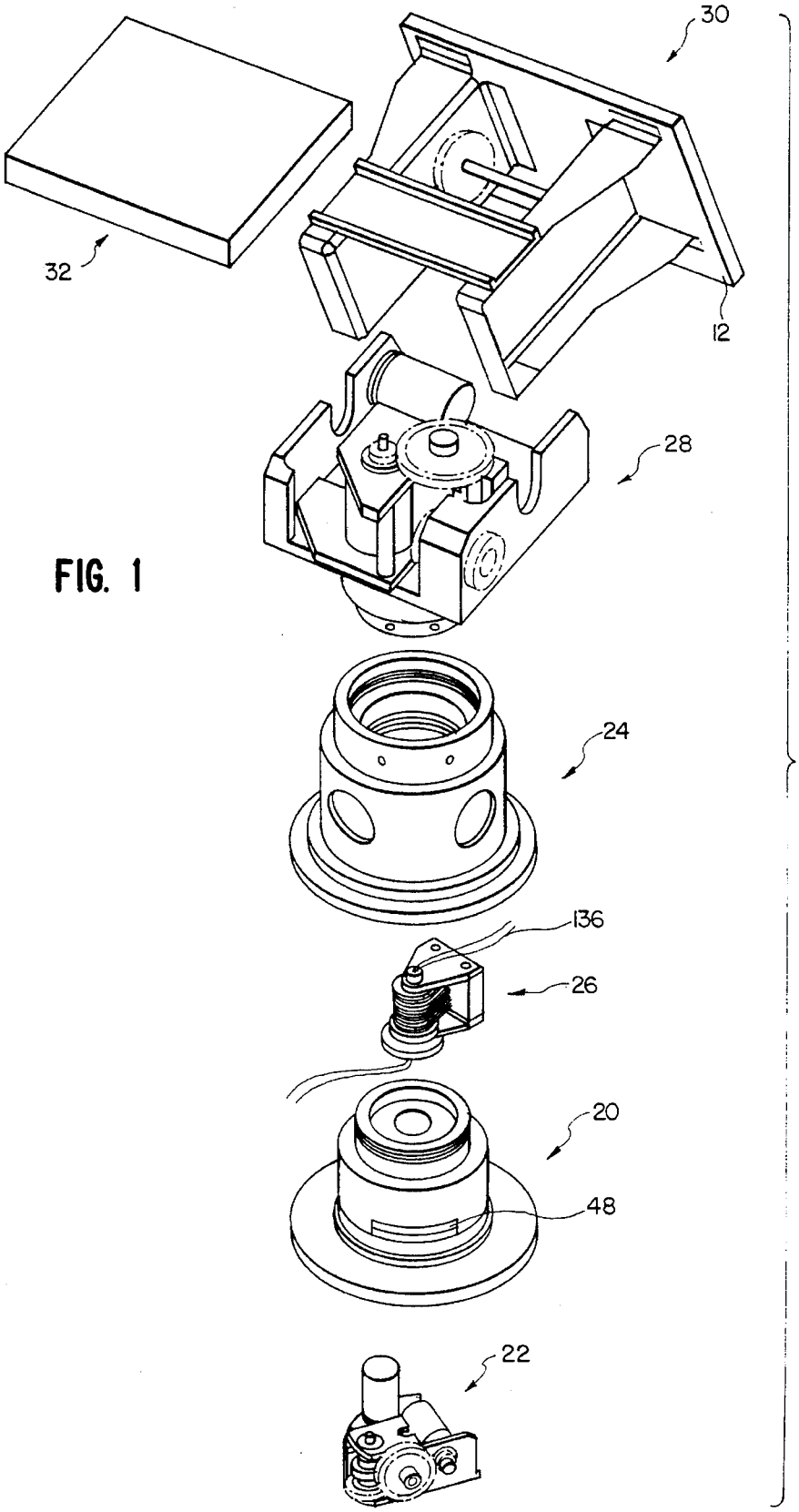
FIG. 1 is an exploded view showing each of the important modules which make up the antenna of the present invention.

FIG. 1 is an exploded view of the antenna 10 according to the present invention. The antenna 10 includes a planar patch array 12 and a dual axis positioner for rotating the array about azimuth and elevation axes. The dual axis positioner is unique in that it consists of a plurality of modules which can be easily assembled and disassembled. The positioner consists of the following modules: a fixed pedestal 20, an azimuth drive module 22, an azimuth rotary module 24 (or drive sleeve), an RF/slip ring module 26, an elevation drive module 28, an antenna support 30 and an electronic module 32. As described in greater detail below, pedestal 20 remains fixed and the azimuth drive module 22 is mounted within the pedestal. The azimuth rotary module 24 slips over and is clamped by retaining nuts on the inner and outer race of the bearing so that it rotates about the vertical or azimuth axis and is driven by the azimuth drive module 22. The elevation drive module 28 is fixed to the azimuth rotary module 24 and rotatably supports the antenna support module 30. The elevation drive module 28 includes a drive mechanism for causing the antenna support module 30 and, attendantly, the antenna array 12 secured thereto, to rotate about the elevation axis. Finally, the RF/slip ring module 26 is provided within the elevation drive module 28 for supplying RF power to the antenna array and for supplying AC/DC power and drive command signals to the elevation drive module.

Figure 2A:
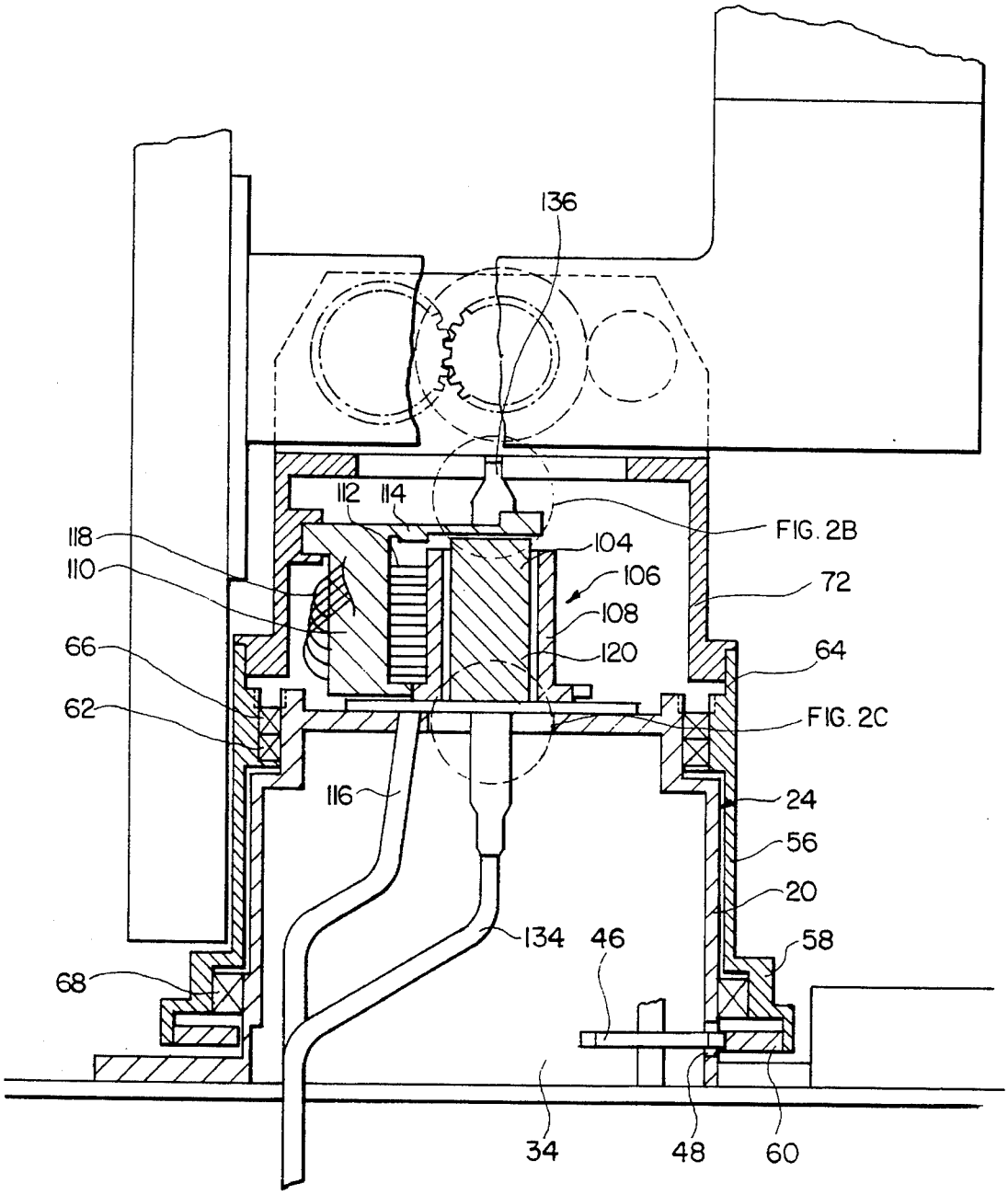
FIGS. 2(*a*)–2(*c*) are sectional views of the antenna.
Figure 2B:
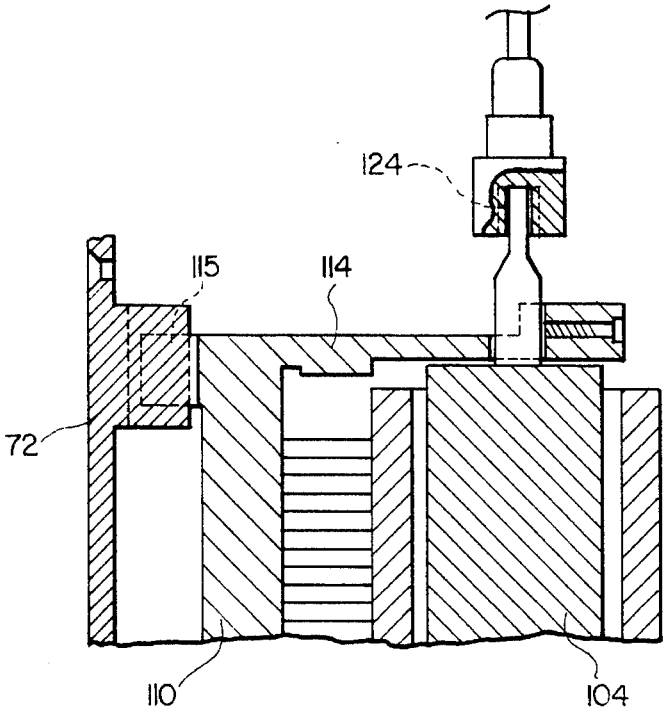

The various modules and the manner in which they are interconnected to one another will now be described in detail in reference to FIGS. 2–6. FIG. 2 is a sectional view of the antenna showing the manner in which the various modules are arranged. However, for the purpose of clarity, the azimuth drive module is not completely shown in FIG. 2. FIG. 3 shows the sectional view of azimuth rotary module 24.

Figure 4:
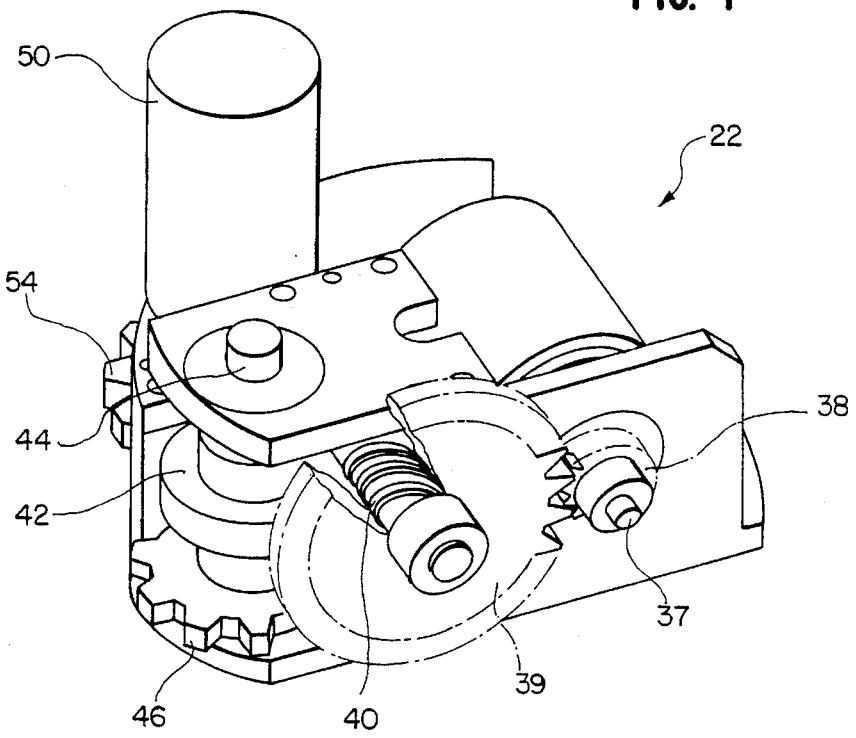
FIG. 4 is a perspective view of the azimuth drive module.

The pedestal 20 is cup-shaped so as to define a recess 34 therein in which the azimuth drive module 22 is received, as shown in FIGS. 2 and 4. The azimuth drive module 22 includes a servo motor 36 having an output shaft 37 to which a first azimuth gear 38 is secured. The first gear 38 is meshed with second azimuth gear 39 so as to rotate worm 40. The worm 40 is meshed with worm gear 42 for rotating a shaft 44 to which an output gear 46 is fixedly secured. Thus, rotation of the servo motor 36 drives the output gear 46 via first azimuth gear 38, second azimuth gear 39, worm 40 and worm gear 42. It is noted that the pedestal has a slot 48 in a side wall thereof through which the output gear 46 protrudes for meshing with an internal gear provided on the azimuth rotary module 24, as discussed below.

Additionally, the azimuth drive module includes a synchro 50 having a synchro output shaft 52 to which a synchro gear 54 is secured. The synchro gear 54 also protrudes through a slot provided in the side wall of the pedestal 20 so as to engage the internal gear of the azimuth rotary drive module. Thus, the synchro provides an output signal indicative of the angular position of the antenna with respect to the azimuth axis.

Referring to FIGS. 2 and 3, the azimuth rotary module 24 includes an annular housing 56. The bottom portion of this housing is stepped so as to define a lower bearing portion 58 and a lower gear portion which includes the internal gear 60, discussed above. Provided at the top of the housing 56 is an upper bearing portion 62 defined by a stepped ledge and an upper flange 64 to which the elevation drive module is attached, as described in greater detail below.

FIG. 2 illustrates the manner in which the azimuth rotary module 24 is rotatably supported by the pedestal 20. The annular housing 56 is slid over the pedestal and is rotatably supported thereon by upper and lower bearings 66 and 68 respectively supported by the upper and lower bearing portions 62 and 58 of the azimuth rotary module 24. The bearing arrangement is conventional so that a description thereof has been omitted. As noted above, the output gear 46 of the azimuth rotary drive module 22 protrudes externally of the pedestal 20 so that it is in meshing engagement with the internal gear 60 of the azimuth rotary module 24. Therefore, actuation of the azimuth servo motor 36 causes the azimuth rotary module 24 to rotate about the azimuth axis.

Figure 5:
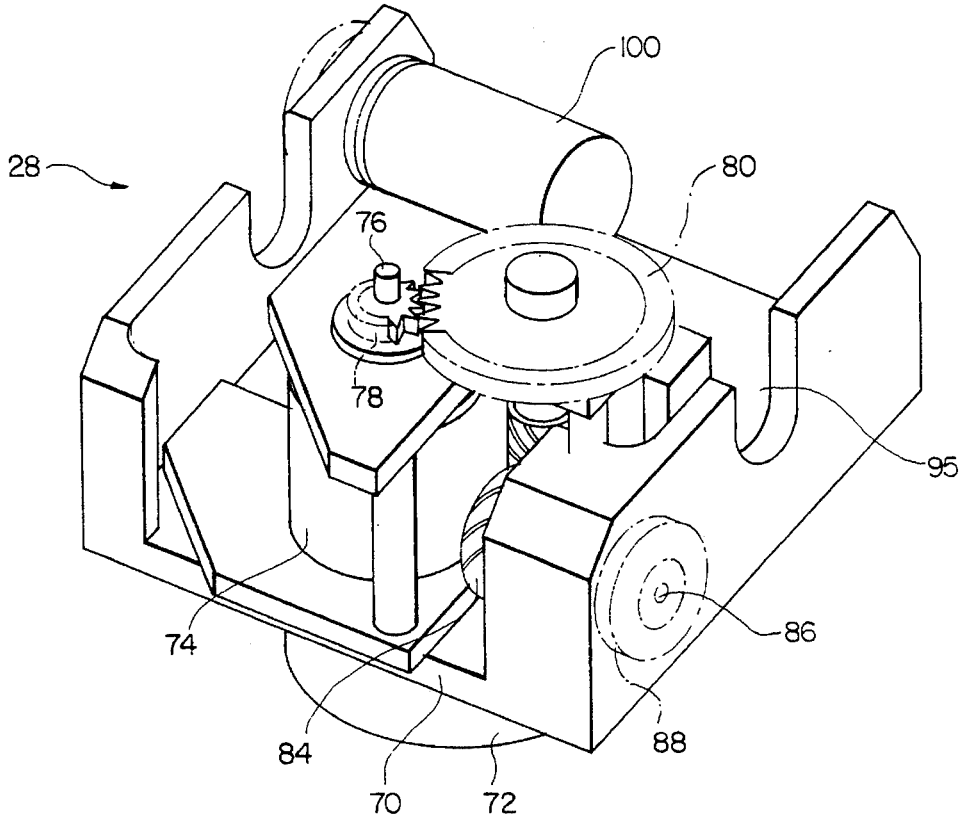
FIG. 5 is a perspective view of the elevation drive module.

The elevation drive module 28 is specifically shown in FIG. 5 of the application. The elevation drive module 28 includes a base 70 with a downwardly protruding support ring 72 which is fixedly secured to the upper flange 64 of the azimuth rotary module 24. Thus, rotation of the azimuth rotary module 24 about the azimuth axis causes the elevation drive module 28 to rotate as well. The elevation drive module further includes an elevation servo motor 74 having an output shaft 76 to which a first elevation gear 78 is secured. The first gear 78 is meshed with second elevation gear 80 which is attached to elevation worm 82. The worm 82 is correspondingly meshed with elevation worm gear 84 which is attached to output shaft 86 having an elevation output gear 88 also secured thereto. Thus, rotation of the output shaft 76 of the servo motor 74 is transmitted to the elevation output gear 88 via first elevation gear 78, second elevation gear 80, elevation worm 82 and elevation worm gear 84.

Figure 7:
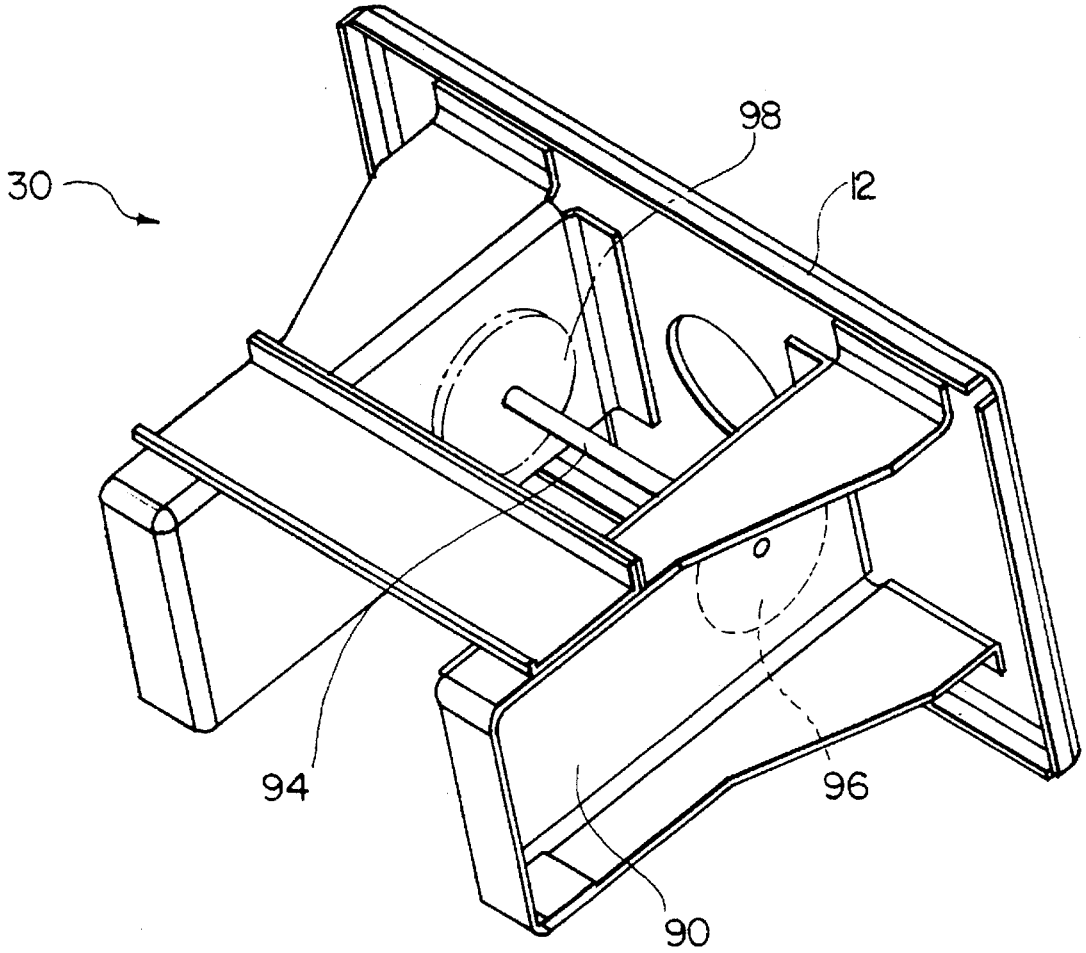
FIG. 7 is a perspective view of the antenna support module.

Referring to FIG. 7, the antenna support 30 includes a pair of support arms 90 interconnected by a support bracket 92. The antenna array 12 is secured on a front side of the antenna support. A pivot shaft 94 is secured at opposite ends thereof to the support arms 90 and includes a drive gear 96 and an antenna synchro gear 98 fixedly secured thereto at opposite ends. The pivot shaft 94 is received in slots 95 of the elevation drive module so that the elevation output gear 88 on the elevation drive module 28 is meshed with the drive gear 96. Therefore energization of the elevation servo motor 74 causes the antenna array 12 to rotate about the elevation axis.

It is noted that an elevation synchro 100 is provided on the elevation drive module 28 and includes a synchro input gear 102 which meshes with the antenna synchro gear 98. In this manner the specific angular orientation of the antenna with respect to the elevation axis is continuously and directly detected.

Figure 2C:
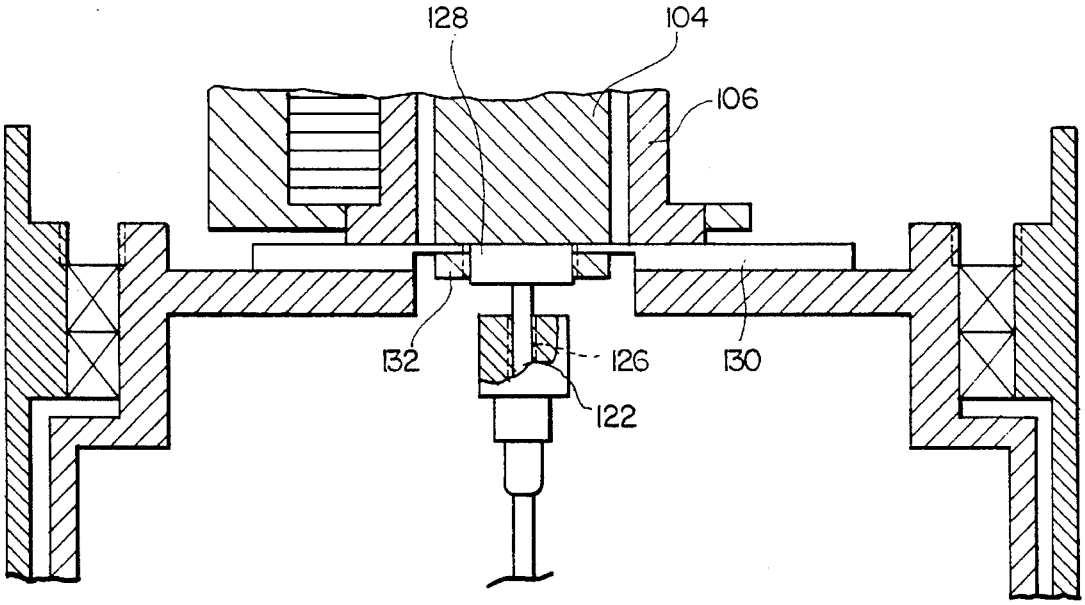
Figure 3:
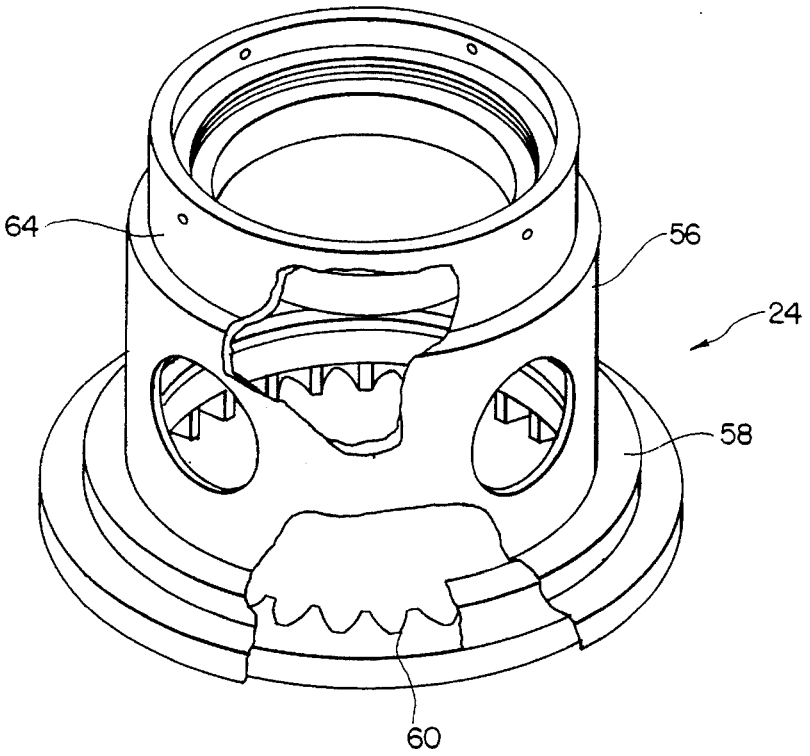
FIG. 3 is a perspective view of the azimuth rotary module of the antenna according to the present invention.
Figure 6:
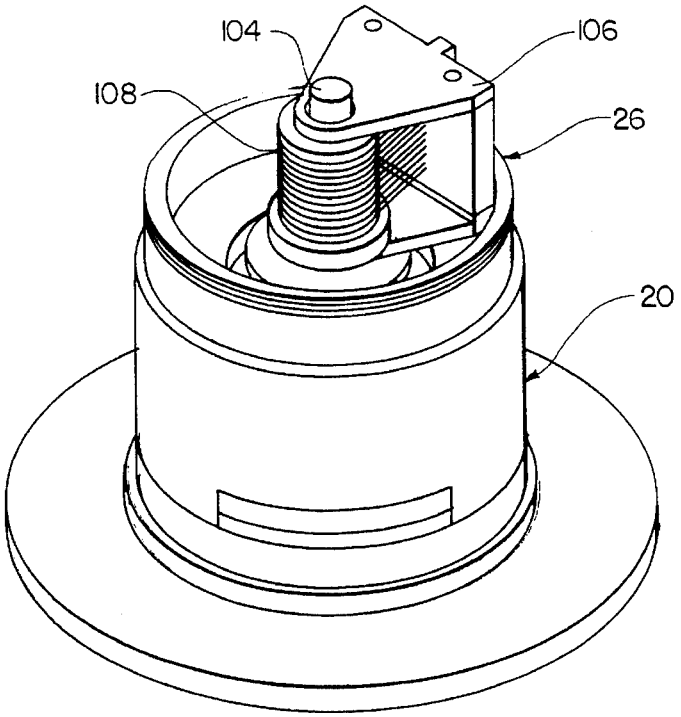
FIG. 6 is a perspective view of the RF/slip ring module disposed on the pedestal.

An important aspect of the invention relates to the design of the RF/slip joint module 26 shown in FIGS. 2 and 6. This module enables RF power to be transmitted to the antenna array 12 and AC/DC power and drive command signal to be transmitted to the synchro 100 and drive motor 74 of the elevation drive module 28 while allowing the antenna to continuously rotate about the azimuth axis. Importantly, the module includes both an RF joint 104 as well as a slip ring 106 in a single module, rather than separately providing the RF joint and the slip ring. The slip ring 106 is conventional and can be purchased from Airflyte (P/N 85R-895). Such a conventional slip ring 106 includes a sleeve 108 having a plurality of conductive tracks or grooves therearound and a brush block 110 having a plurality of brushes 112 which are positioned so as to ride in the conductive tracks, respectively. The sleeve 108 is fixedly secured on the top assembly support plate 130 which is secured to the top of the pedestal 20 so as to remain stationary, as shown in FIG. 2C. Any conventional fastener may be used for this purpose. On the other hand, the brush block 110 is secured to the top rotating portion of the RF joint and a bushing joint to rotate about the stationary base of the slip ring 106. The top rotating portion, or arm 114, of the RF joint has an outer keyway 115 enabling it to be rotated by a key slot in the support ring 72. In particular, the brush block 110 is secured to a support arm 114 which is fixed to and extends radially inwardly from the support ring 72. According to the invention, the elevation drive input wires encapsulated in input cable 116 are connected directly to the sleeve 108 of the slip ring 106. Further, a plurality of wires 118 are respectively connected to the brushes 112 of the brush block 110 at one end thereof and to the elevation drive module 28 at the other end thereof. Therefore, DC power is supplied from the input wires to the elevation drive module 28 via the slip ring thereby enabling the antenna array to rotate continuously about the azimuth axis.

The RF joint is conventional and can be purchased from SAGE Laboratory (P/N 345C). The RF joint 104 includes a housing 120, an input terminal 122 fixedly disposed at one end of the housing and an output terminal 124 rotatably disposed at the opposite end of the housing. According to the invention, the RF joint 104 is secured to the top of the pedestal 20 and is disposed within the hole defined by the sleeve 108 of the slip ring 106 with the stationary input terminal 122 extending downwardly and the rotatable output terminal 124 extending upwardly. The conventional RF joint includes a threaded portion 126 on the fixed terminal end which protrudes through an opening 128 in a support plate 130 attached to the pedestal. The RF joint 104 is secured to the support plate 130 with a nut 132 which is screwed on the threaded portion 126.

The rotatable output terminal 124 is fixed to the above described support arm 114 and rotated by the support ring 72 via the keyway drive. Therefore, rotation of the support ring 72 about the azimuth axis causes the rotatable output terminal 124 of the RF joint 104 to correspondingly rotate. Accordingly, RF power can be supplied to the antenna array by attaching an input cable 134 to the stationary input terminal 122 of the RF joint and interconnecting an output cable 136 to the rotatable output terminal 124 and the antenna array while allowing the antenna to rotate.

As shown in FIG. 1, the electronic control module 32 is secured to the top of the antenna support module 30. The electronic module interprets the drive signal from an external controller and converts this information into the power drive signal for the motor.

Figure 8:
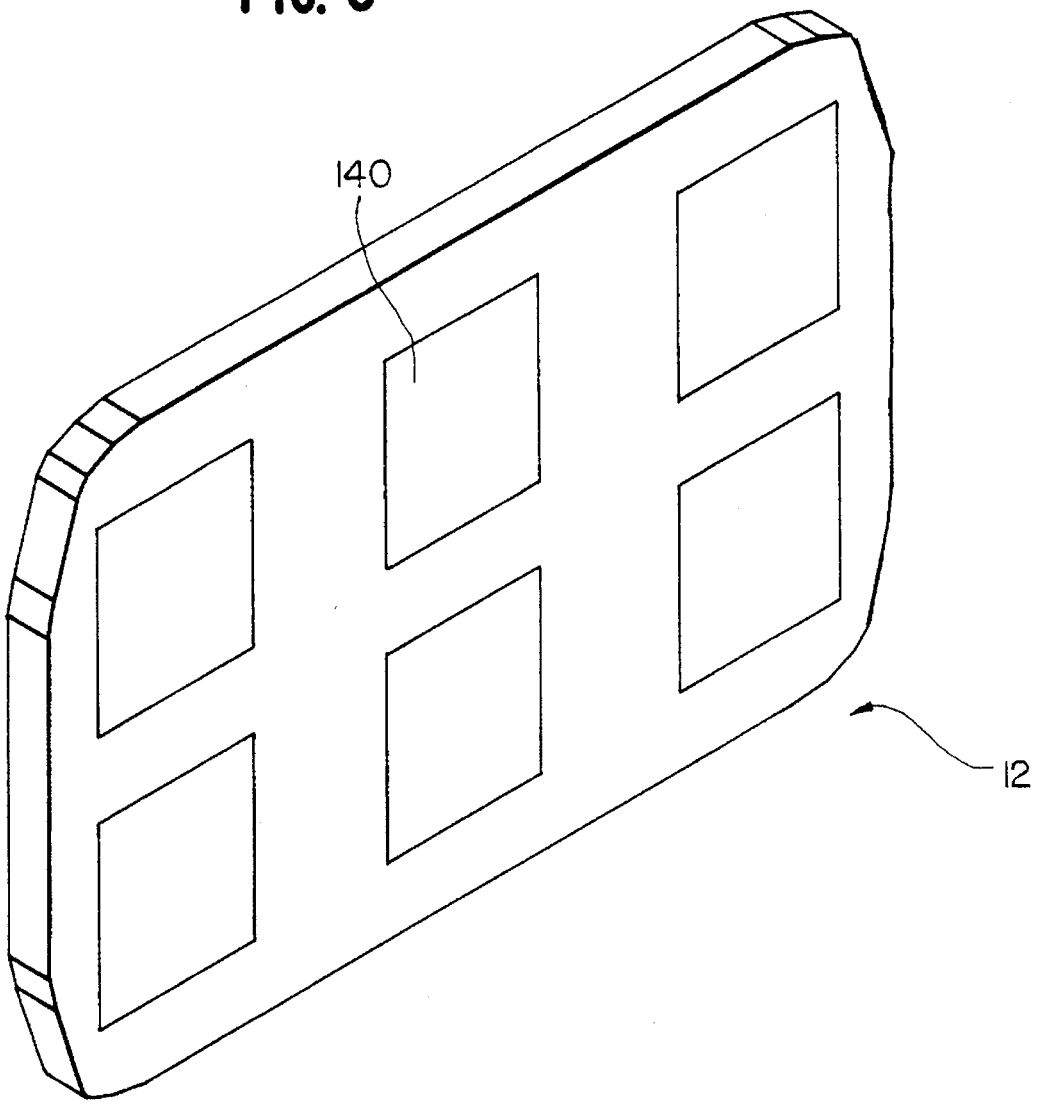
FIG. 8 is a perspective view of the antenna array.

The antenna array is illustrated in FIG. 8 and includes six elements 140 arranged in a 3×2 planar configuration with the Y-plane spacing A of 0.60λ and the X-plane spacing B of 0.75λ. Each element is fed in quadrature via a 3 dB branchline coupler to obtain right-hand circular polarization. The power divider network is designed to produce an amplitude taper across the 3-element axis of the array while maintaining an even split across the 2-element axis. The primary purpose of this technique is to achieve lower side lobe levels. According to the preferred embodiment of the invention, the selected voltage taper is 1, $\sqrt{2}$, 1 so as to provide an amplitude taper across the X-plane aperture resulting in a power distribution of −6, −3, −6 dB. Such an arrangement has two significant advantages which are higher aperture efficiency and easier implementation. Further, the radiation pattern results in a reduction of directive gain and a significant reduction in sidelobe levels. The overall result is actually a widening of the main lobe with no decrease in gain.

The array operates at INMARSAT frequencies (i.e., in the 1530–1660 MHz frequency range). The elements 140 are "powered" via a three-layer setup comprising a network of feedlines which are connected together centrally, and the two-layer elements themselves. The feedlines are implemented in stripline, and the elements are coupled to respective feedlines in the network. The elements are constructed of two layers including a feed layer and a capacitively coupled director layer to provide high element gain. Further details of implementation would be well within the abilities of the ordinarily skilled artisan, and so need not be provided here.

The antenna is assembled in such a manner that the center of gravity of the flat plate array is essentially aligned with the center line of the positioner resulting in a minimal imbalance. Therefore, the torque output and power dissipation of the positioner may be kept to a minimum resulting in a light weight positioner.

In addition to allowing for easy replacement of individual modules as discussed above, the dual axis positioner is advantageous in that each of the individuals modules may be manufactured at smaller manufacturing centers, the modules may be individually tested and identification of system failure may be performed on a modular level.

Although the invention has been described and shown in terms of preferred embodiments thereof, it will be understood by those skilled in the art that changes in form and detail may be made therein without departing from the spirit and scope of the invention as defined in the appended claims.

What is claimed is:

1. An antenna, comprising:

an array assembly;

a pedestal having a recess therein;

elevation drive means connected to said array assembly for rotating said array assembly about an elevation axis; and azimuth drive means for rotating said elevation drive means and, attendantly, said array assembly about an azimuth axis, at least a portion of said azimuth drive means being disposed within said recess of said pedestal, wherein said pedestal is cup-shaped including a side wall and a top plate, said side wall having a gear receiving slot therein, and wherein said azimuth drive means comprises:

an azimuth drive module disposed within said recess and including an azimuth drive motor and an azimuth output gear driven by said azimuth drive motor, a portion of said azimuth output gear extending through said gear receiving slot of said pedestal; and a drive sleeve substantially circumscribing said pedestal; and bearing means for rotatably supporting said drive sleeve on said pedestal so that said drive sleeve is rotatable about said azimuth axis, said drive sleeve including gear means which is meshed with said output gear such that energization of said azimuth drive motor causes said drive sleeve to rotate about said azimuth axis.

2. The antenna of claim 1, wherein said gear means includes an internal gear.

3. The antenna of claim 1, wherein said elevation drive means is supported on said drive sleeve.

4. The antenna of claim 3, wherein said elevation drive means comprises:

an elevation drive module including an elevation drive motor and an elevation output gear and gear means interconnecting said drive motor and said elevation output gear.

5. The antenna of claim 4, wherein said array assembly includes an array and an array support to which said array is fixed, said array support being rotatably disposed on said elevation drive module and including a driven gear which is meshed with said elevation output gear such that energization of said elevation drive motor causes said array to rotate about said elevation axis.

6. The antenna of claim 1, further comprising:

an RF joint secured to said pedestal and including a housing, a fixed input terminal fixed to said housing and a rotatable output terminal rotatable with respect to said housing; and a support arm connected at one end thereof to said sleeve and at the opposite end thereof to said output terminal such that rotation of said sleeve causes said output terminal to rotate.

7. The antenna of claim 6, wherein said housing is secured to a top of said top plate of said pedestal and protrudes into the opening defined by said sleeve.

8. The antenna of claim 6, further comprising a slip ring for supplying current to said elevation drive means, said slip ring including a tubular member having a plurality of conductive tracks circumscribed therearound to which input wires are respectively connected and a brush block including a plurality of brushes extending therefrom and respectively contacting said tracks, said brush block having a plurality of wires electrically connected to said brushes, respectively.

9. The antenna of claim 8, wherein said tubular member is secured to said pedestal with said RF joint disposed within the opening defined by said tubular member and said brush block is secured to said drive sleeve.

10. A device for supplying RF power to an antenna array and AC/DC power and a drive command signal to a drive means for rotating said array about a first axis, said drive means being rotatably supported on a pedestal so as to be rotatably about a second axis, said device comprising:

an RF joint for supplying said RF power, said RF joint including a housing secured to said pedestal, a fixed input terminal fixed to said housing and a rotatable output terminal rotatable with respect to said housing;

connecting means for connecting said output terminal to said drive means such that rotation of said drive means about said second axis causes said output terminal to rotate about said second axis;

a slip ring for supplying said DC power, said slip ring including a sleeve having a plurality of conductive tracks circumscribed therearound to which input wires are respectively connected and a brush block including a plurality of brushes extending therefrom and respectively contacting said tracks, said brush block having a plurality of wires electrically connected to said brushes, respectively, wherein said housing is disposed within the opening defined by said sleeve.

11. The device of claim 10, wherein said sleeve is fixed to said pedestal.

12. The device of claim 11, wherein said brush block is connected to said output terminal so as to rotate therewith.

13. The device of claim 10, further comprising: first means for securing said sleeve to said pedestal; and second means for securing said brush block to said output terminal so that said brush block rotates with said output terminal.

14. The device of claim 13, wherein said brush block revolves around said sleeve.

15. A power supplying device for supplying power from a fixed unit to a rotatable unit rotatably supported by said fixed unit, comprising:

a first power supplier for supplying power to the rotatable unit, said first power supplier including a housing secured to said fixed unit, a fixed input terminal fixed to said housing for receiving a first input wire and a rotatable output terminal rotatable with respect to said housing from which output wires lead and connect to said rotatable unit, said rotatable output terminal rotating in response to said rotation of said rotatable unit; and a second power supplier for supplying additional power to the rotatable unit, said second power supplier including a sleeve fixed to said fixed unit and having a plurality of conductive tracks circumscribed therearound to which second input wires are respectively connected and a brush blocking including a plurality of brushes extending therefrom and respectively contacting said tracks, said brush block having a plurality of output wires electrically connected at one end thereof to said brushes, respectively, and at the other end thereof to said rotatable unit, wherein said housing is disposed within the opening defined by said sleeve and wherein said brush block is connected to said rotatable output terminal such that rotation of said rotatable unit causes rotation of said output terminal and said brush block.

* * * * *